United States Patent [19]

Gammie et al.

[11] 3,983,354

[45] Sept. 28, 1976

[54] ROTARY ELECTRIC SWITCH

[75] Inventors: Joseph E. Gammie, Southgate; Bert R. Wanlass, Warren, both of Mich.

[73] Assignee: General Motors Corporation, Detroit, Mich.

[22] Filed: June 30, 1975

[21] Appl. No.: 591,847

[52] U.S. Cl. ..... 200/155 R; 200/44

[51] Int. Cl.[2] ..... H01H 19/28

[58] Field of Search ..... 200/155 R, 44, 42 R, 200/28, 293, 302, 252

[56] References Cited

UNITED STATES PATENTS 2,503,287 4/1950 Moore ..... 200/155 R 3,188,881 6/1965 Pusch ..... 200/155 R

*Primary Examiner*—Herman Hohauser

*Attorney, Agent, or Firm*—Albert F. Duke

[57] ABSTRACT

A rotary switch comprising a housing, a cover, three stationary contacts, a rotor, an O-ring seal, and a combination sealing and driving member. The switch is mounted on the end of a door lock cylinder assembiy of a vehicle and is connected with the vehicle anti-theft system so that insertion of a key into the lock cylinder and rotation of the key in one direction arms the alarm system through the switch while rotation in the opposite direction disarms the system. The switch is entirely self-contained and weatherproof.

4 Claims, 7 Drawing Figures

ROTARY ELECTRIC SWITCH

This invention relates to rotary electric switches and more particularly to a switch which is operable to arm or disarm an automobile anti-theft system in response to operation of the door lock key.

In copending application Ser. No. 523,977, filed Nov. 15, 1974, and assigned to the assignee of the present invention, an anti-theft system is disclosed which is armed by locking the vehicle doors and disarmed by unlocking the vehicle doors. The present invention is directed to a switch structure which is suitably coupled to the lock cylinder assembly of the vehicle door and is actuable to close an electrical circuit in response to clockwise or counter-clockwise movement of the lock cylinder shaft and is, therefore, suitable for use in the system of the aforementioned application.

It is an object of the present invention to provide an improved rotary switch particularly useful for arming and disarming a vehicle anti-theft system.

It is another object of the present invention to provide a rotary switch which is constructed to substantially prevent penetration of moisture and dust.

It is another object of the present invention to provide a switch including a combined driving and sealing member.

Other objects and advantages of the present invention may be had from the following detailed description which should be read in conjunction with the drawings in which.

Figure 1:
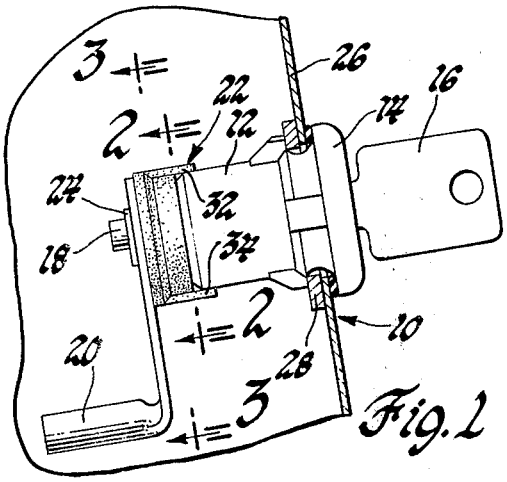
FIG. 1 is an elevation view showing the switch of the present invention secured to a lock cylinder assembly.

Referring now to the drawings and initially to FIG. 1, a lock cylinder assembly generally designated 10 includes a cylinder 12 with an integral head 14. Rotatable within the cylinder 12 is a core (not shown). The core receives a key 16 and has an integral shaft 18 which is rotatable in a clockwise or counter-clockwise direction by the key 16. The shaft 18 drives the usual crank 20 for a vehicle door lock actuating member or linkage. The rotary arm/disarm switch 22 of the present invention is coupled to one end of the cylinder 12 and secured between the crank 20 and the cylinder 12 by a retaining clip 24. The lock cylinder assembly 10 is secured to the vehicle door 26 by the usual retaining ring 28.

Referring now to FIGS. 2-4 and 7, the arm/disarm switch 22 comprises a housing 30 of insulating material which includes a pair of integral fingers 32 and 34 which mate with slots (not shown) in the cylinder 12. The housing 30 also includes an integral T-shaped extension 36 for purposes which will be described more fully hereinafter. The housing 30 is of generally cylindrical shape having a central aperture of first, second and third diameters defined by first portion 38, second portion 40, and third portion 42 respectively. The first portion 38 and second portion 40 define at their juncture a radially inwardly extending shoulder 44. Similarly, the second portion 40 and the third portion 42 define at their juncture a radially inwardly extending shoulder 46. The portion 40 contains a pair of symmetrically opposite grooves 48 and 50. Two stationary contact blades 52 and 54 are located in respective grooves 48 and 50 so that midportions 56 and 58 are disposed to the interior of the housing 30 and are concentric with the second portion defining the second diameter. A cover 60 of insulating material has an integral circular flange portion 62 which extends axially into the housing 30. The cover 60 abuts the shoulder 46 and is suitably secured to the housing 30. The coil spring 64 surrounds the circular flange 62 and abuts the cover 60. A cylindrical shaped rotor 66 of electrically conductive material receives the spring 64. The rotor 66 includes a pair of flexible fingers 70 and 72 which extend radially outwardly and are self-biased into engagement with the inner surface of the portion 40.

Figure 4:
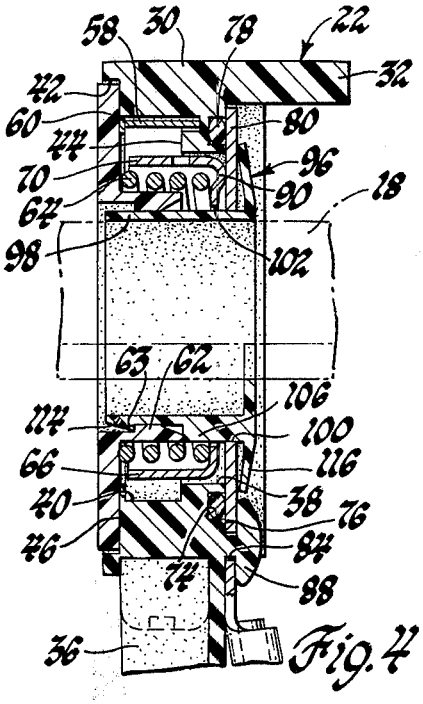
FIG. 4 is a cross-sectional view taken along lines 4—4 of FIG. 3.
Figure 2:
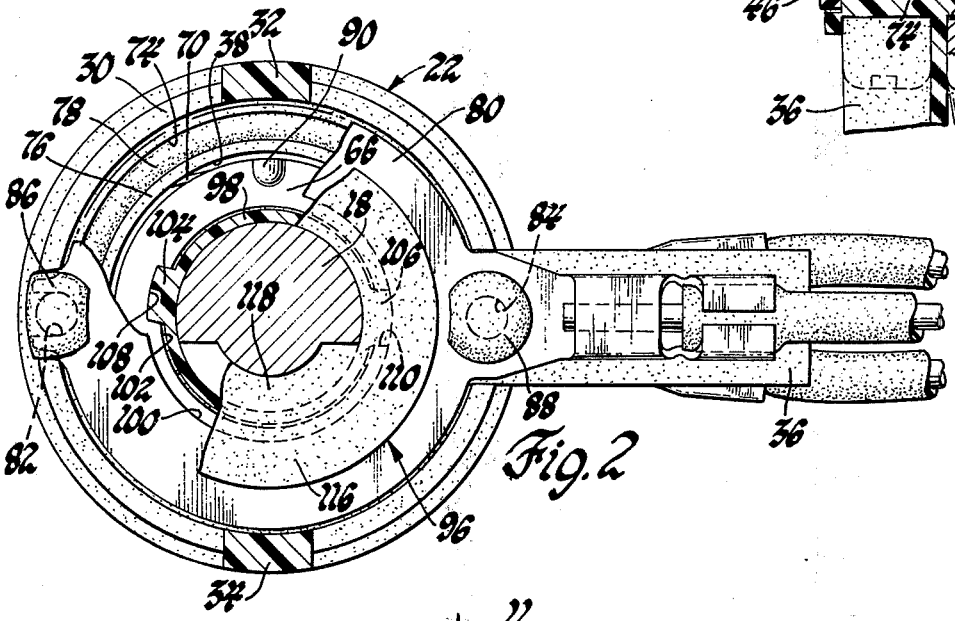
FIG. 2 is a cross-sectional view taken along lines 2—2 of FIG. 1.

An annular groove 74 is formed in the portion 38 in the shoulder 76 which is opposite the shoulder 44 and an 0-ring 78 is located in the annular groove 74. A third stationary contact blade 80 is secured to one end of the housing 30 by heat welding. For this purpose the stationary contact 80 includes a U-shaped opening 82 and a circular opening 84 which receives upstanding projection 86 and 88, which after the application of heat, takes the shape shown in FIG. 4, maintaining the contact blade 80 in sealing engagement with the O-ring 78. The rotor 66 is provided with integral protuberances 90, 92 and 94 which are biased into engagement with the contact blade 80 by the spring 64. A rotor driving and sealing member 96 includes a circular flange 98 which extends through an opening 100 in the contact blade 80 and an opening 102 in the rotor 66. The circular flange 98 includes integral projections 104 and 106 which are keyed in slots 108 and 110 respectively of the rotor 66 so that rotational movement of the member 96 drives the rotor 66. The circular flange further includes integral tangs 112 and 114 which snap into engagement with the portion 63 of the circular flange 62 of the cover 60 to thereby contain the various elements of the switch in a single assembly. As best shown in FIG. 4, the washer shaped head 116 of the member 96 is canted and maintains sealing engagement with the contact blade 80. The member 96 is keyed to the shaft 18 by a portion 118 which is shaped to mate with the shaft 18. Lubricant is preferably applied to the interfaces areas between the driving member 96 and the cover 60 and the contact 80 to help prevent penetration of moisture and dust.

The T-shaped extension 36 of the housing 30 separates and insulates the contacts 52, 54 and 80 and allows them to be taped in one operation into rigid grouping that eliminates loose wire flex problems at the switch.

Figure 3:
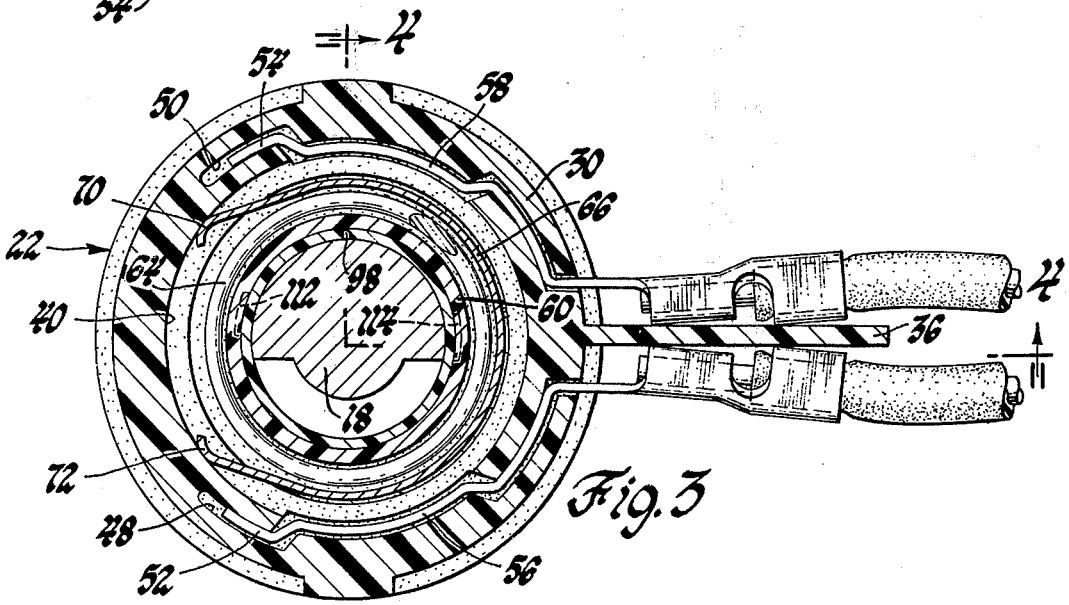
FIG. 3 is a cross-sectional view taken along lines 3—3 of FIG. 1.
Figure 5:
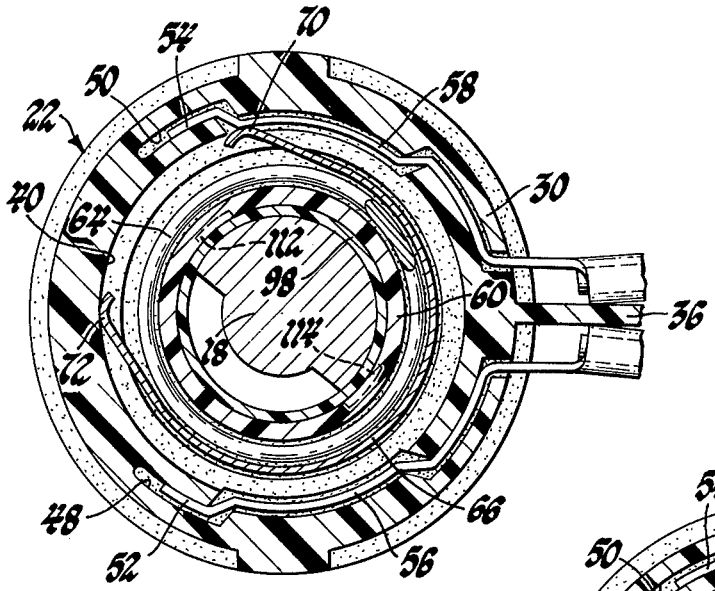
FIGS. 5 and 6 are cross-sectional views similar to FIG. 3 but show the switch in the arm and disarm positions respectively.
Figure 6:
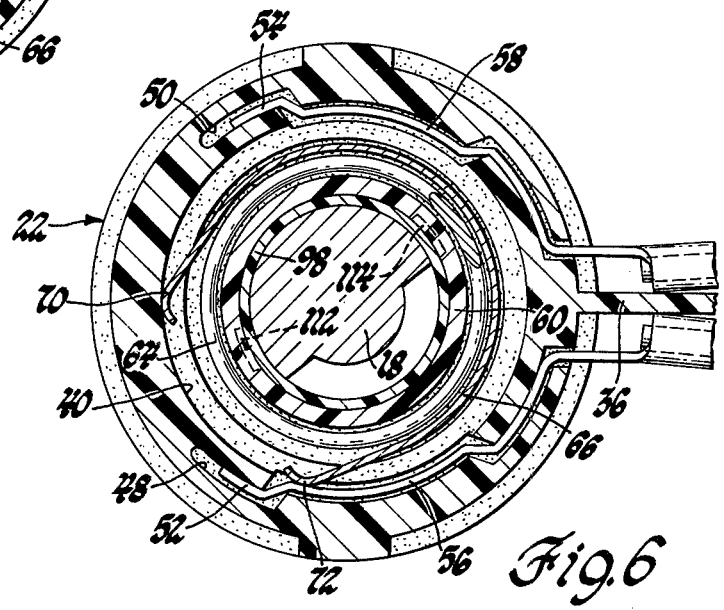
Figure 7:
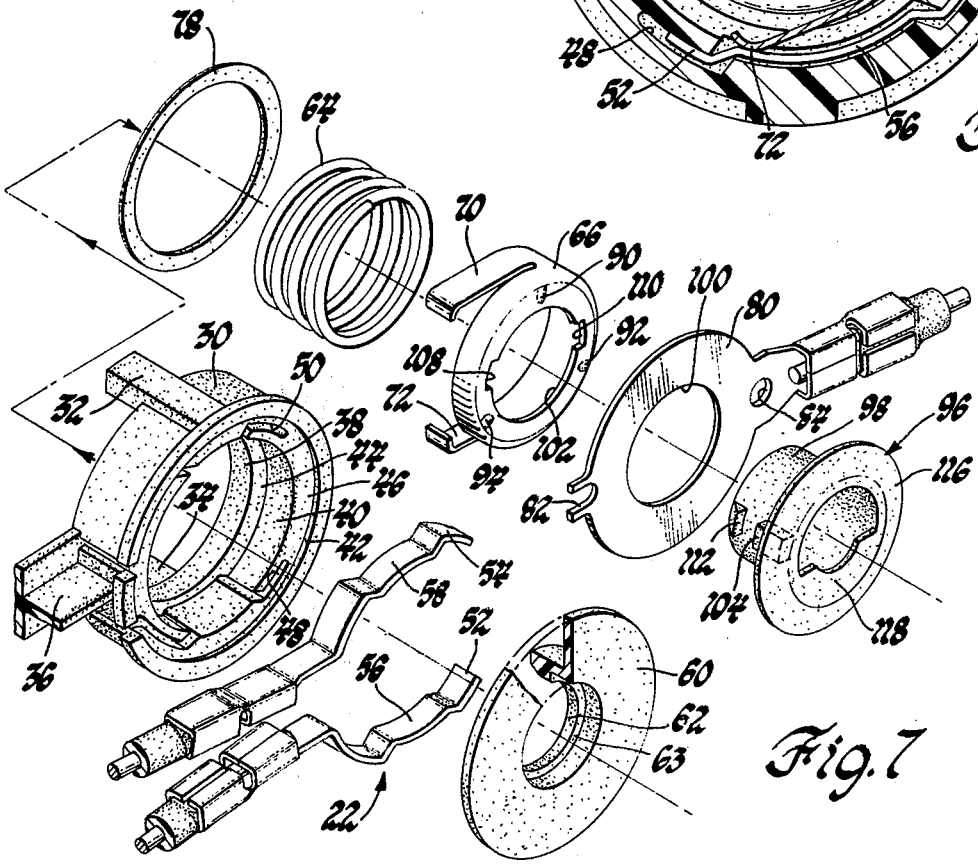
FIG. 7 is an exploded view of the switch structure of the present invention.

The operation of the switch will now be described with reference to FIGS. 3, 5 and 6. It is to be understood that the contact 80 is connected with electrical ground and the contacts 52 and 54 are connected with circuitry for selectively arming or disarming an alarm system. When the key 16 is rotated in a clockwise direction to lock the vehicle doors, the switch is moved from the neutral position shown in FIG. 3 to the position shown in FIG. 5. thereafter, the key 16 is removed by returning to the neutral position shown in FIG. 3. To unlock the vehicle doors and disarm the system the key 16 is moved in a counter-clockwise direction to move the switch from the neutral position shown in FIG. 3 to the disarm position shown in FIG. 6. In the neutral position the flexible fingers 70 and 72 engage the inner surface of the portion 40 and are out of engagement with the contacts 52 and 54. When moved to the arm position shown in FIG. 5, the finger 70 engages the midportion 58 of the contact 54 and when moved to the disarm position shown in FIG. 6, the finger 72 engages the midportion 56 of the contact 52.

Having thus described our invention what we claim is:

1. A rotary electric switch comprising cylindrical housing means of insulating material having an integral circular flange portion defining first and second interior wall surfaces of first and second internal diameters respectively, the second internal diameter being greater than said first internal diameter, an annular groove formed in said flange portion, an O-ring seal located in said annular groove, a first contact blade in abutting relationship with said flange portion and in sealing engagement with said seal, second and third contact blades extending through said housing means, at least a portion of each of said second and third contact blades being exposed to the interior of said housing means, said housing means including a cover portion of insulating material secured at one end of said housing, a cylindrical shaped rotor member of electrically conductive material having a pair of integral flexible fingers extending radially outward therefrom and self-biased into engagement with said second interior wall surface, said fingers being located in transverse plane containing said portions of said second and third contacts so that said fingers engage and disengage with said portions of said second and third contact blades as said rotor is rotated, spring means biasing said rotor away from said cover and into engagement with said first contact blade, a rotor driving and sealing member keyed to said rotor for selectively rotating said rotor in a clockwise or counter-clockwise direction for establishing an electrically conductive path between said first contact blade and said second or third contact blades through one or the other of said pair of fingers respectively, said first contact blade and said rotor member and said cover portions having axially aligned openings therein, said rotor driving and sealing member including an integrally formed cylindrical flange portion axially extending through the opening of said first contact blade, said rotor member and said cover member and rotatably coupled to said cover member.

2. A rotary electric switch comprising a hollow cylindrical member of insulating material having an interior wall surface and an integral circular flange radially inwardly extending from said interior wall normal to the longitudinal axis of the housing member, said flange including an annular groove therein, an 0-ring seal located within said annular groove, a washer shaped first contact blade in sealing relationship with said O-ring and having an opening therethrough, second and third contact blades extending through said interior wall of the housing member, a portion of each of said second and third contact blades being exposed to the interior of said housing, said housing means including a cover portion of insulating material engaging one end of said housing and having an integral cylindrical flange portion extending axially into said housing, a cylindrical shaped rotor member of electrically conductive material having an opening therein and having a pair of integral flexible fingers extending radially outwardly therefrom and self-biased into engagement with said interior wall surface, said fingers being located in the transverse plane containing said portions of said second and third contact blades so that said fingers engage and disengage with said portions of said second and third contact blades as said rotor is rotated, coil spring means surrounding said cylindrical flange portion of said cover portion and biasing said rotor away from said cover and into electrical contact with said washer shaped contact blade, a rotor driving and sealing member keyed to said rotor for selectively rotating said rotor in a clockwise or counter-clockwise direction for establishing an electrically conductive path between said washer shaped contact blade and said second or third contact blades through one or the other of said pair of fingers respectively, said rotor driving member including an integrally formed cylindrical flange portion axially extending through the opening in said washer shaped contact blade and the opening in said rotor member and extending into and rotatably coupled with the interior of said cylindrical flange portion of said cover member.

3. A rotary electric switch comprising a hollow cylindrical housing means of insulating material having first and second integral circular flange portions forming first and second interior wall surfaces defining first and second internal diameters of said housing means, seal means located on said first flange portion, a first contact blade in abutting relationship with said first flange portion and in sealing engagement with said seal means, second and third contact blades located within said second flange portion, at least a portion of each of said second and third contact blades being exposed to the interior of said housing means, said housing means including a cover portion of insulating material secured to one end of said housing and having an integral cylindrical flange portion extending axially into said housing, a cylindrically shaped rotor member of electrically conductive material having a pair of integral flexible fingers extending radially outwardly therefrom and self-biased into engagement with said second interior wall surface, said fingers being located in the transverse plane containing said portions of said second and third contact blades so that said fingers engage and disengage with said portions of said second or third contact blades as said rotor is rotated, spring means biasing said rotor away from said cover and into engagement with said first contact blade, a rotor driving and sealing member keyed to said rotor for selectively rotating said rotor in a clockwise or counterclockwise direction for establishing an electrically conductive path between said first contact blade and said second or third contact blades through one of the other of said pair of fingers respectively, said first contact blade and said rotor member having axially aligned openings therein, said rotor driving member including an integrally formed cylindrical flange portion axially extending through the opening in said first contact blade, and in said rotor member, and extending into and rotatably coupled with the cylindrical flange portion of said cover portion.

4. A rotary electric switch comprising a cylindrically shaped housing member having a central aperture of first, second and third diameters defined by first, second and third portions respectively, said first and second portions defining at their junction a radially inwardly extending shoulder, said second and third portions defining at their juncture a second radially inwardly extending shoulder, said portion containing a pair of symmetrically opposite grooves which extend through said second portion and into said first portion, first and second stationary contact blades located in said opposite grooves so that midportions of said first and second contact blades are disposed to the interior of said housing member, a cover member of insulating material which abuts said second shoulder and is secured thereto, said cover member having an integral circular flange portion which extends axially into said housing member, a coil spring surrounding said circular flange of said cover member, a cylindrically shaped rotor member of electrically conductive material having a pair of integral flexible fingers extending radially outwardly therefrom and self-biased into engagement with the inner surface of said second portion, said rotor member including an opening of smaller diameter than the diameter of said coil spring, said rotor member engaging said coil spring and biased away from cover member by said coil spring, said first portion having an annular groove formed in a shoulder thereof which is opposite to said first shoulder, an O-ring seal located in said annular groove, a third contact blade secured to one end of said housing in sealing engagement with said O-ring, said coil spring biasing said rotor member into continuous electrical engagement with said third contact blade, a rotor driving and sealing member keyed to said rotor for selectively rotating said rotor in a clockwise or counterclockwise direction for establishing an electrically conductive path between said third contact blade and said first or second contact blade through one or the other of said pair of fingers respectively, said first contact blade and said rotor member having axially aligned openings therein, said rotor driving and sealing member including an integrally formed cylindrical flange portion axially extending through the opening in said third contact blade and said rotor member, the flange portion of said driving and sealing member including integral tangs which rotatably coupled said driving and sealing member with the interior of said cylindrical flange portion of said cover member.

* * * * *

UNITED STATES PATENT AND TRADEMARK OFFICE

CERTIFICATE OF CORRECTION

PATENT NO. : 3,983,354

DATED : September 28, 1976

INVENTOR(S) : Joseph E. Gammie, Bert R. Wanlass

It is certified that error appears in the above-identified patent and that said Letters Patent are hereby corrected as shown below:

Column 2, line 14, "The" should read -- A --.

line 16, "cylindrical" should read -- cylindrically --.

line 51, "interfaces" should read -- interface --.

line 67, "thereafter" should read -- Thereafter --.

Column 4, line 55, "of" should read -- or --.

Column 5, line 2, before "portion" insert -- second --.

line 20, before "cover" insert -- said --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*